US008393023B2

(12) United States Patent
Choi

(10) Patent No.: US 8,393,023 B2
(45) Date of Patent: Mar. 12, 2013

(54) COLLAPSIBLE BED FRAME

(76) Inventor: Kwan-Jun Choi, kyoungNam (KR)

( * ) Notice: Subject to any disclaimer, the term of this patent is extended or adjusted under 35 U.S.C. 154(b) by 0 days.

(21) Appl. No.: 12/518,079

(22) PCT Filed: Jun. 11, 2007

(86) PCT No.: PCT/CN2007/001842

§ 371 (c)(1),
(2), (4) Date: Jun. 5, 2009

(87) PCT Pub. No.: WO2008/122157

PCT Pub. Date: Oct. 16, 2008

(65) Prior Publication Data

US 2010/0293714 A1 Nov. 25, 2010

(30) Foreign Application Priority Data

Apr. 5, 2007 (CN) ..... 2007 2 0006729 U

(51) Int. Cl.
*A47C 17/64* (2006.01)

(52) U.S. Cl. ..... 5/111; 5/117

(58) Field of Classification Search ..... 5/110–112, 5/114–117, 174, 176.1, 178–182, 200.1–202, 5/187, 310, 312–315.1, 316; 108/118
See application file for complete search history.

(56) References Cited

U.S. PATENT DOCUMENTS

| | | | | | |
|---|---|---|---|---|---|
| 186,650 | A | * | 1/1877 | White | 248/439 |
| 242,197 | A | * | 5/1881 | Griffith | 5/117 |
| 648,304 | A | | 4/1900 | Routier | |
| 718,159 | A | | 1/1903 | Rundgvist | |
| 729,486 | A | * | 5/1903 | Cantor | 5/117 |
| 829,454 | A | * | 8/1906 | Wykert | 5/117 |
| 1,122,284 | A | | 12/1914 | Kyle | |
| 1,167,123 | A | | 1/1916 | Sinclair | |
| 1,204,792 | A | | 11/1916 | Kyle | |
| 1,409,380 | A | | 3/1922 | Irwin et al. | |
| 1,577,204 | A | | 3/1926 | Davis | |
| 1,577,205 | A | | 3/1926 | Davis | |
| 1,602,115 | A | | 10/1926 | Malls | |
| 1,693,537 | A | | 11/1928 | Adkins at al. | |
| 1,763,447 | A | | 6/1930 | Schilling | |
| 1,810,311 | A | | 6/1931 | Frey | |
| 2,591,551 | A | | 4/1952 | Kaplan | |
| 3,967,330 | A | | 7/1976 | Zawadowsky | |
| 4,243,263 | A | | 1/1981 | Thiboutot | |
| 4,670,921 | A | | 6/1987 | Avni et al. | |
| 6,553,586 | B1 | | 4/2003 | Lin | |
| 6,618,879 | B1 | | 9/2003 | Wu | |
| 2006/0174415 | A1 | | 8/2006 | Moulton | |

FOREIGN PATENT DOCUMENTS

| | | | |
|---|---|---|---|
| CN | 2376227 | Y | 5/2000 |
| CN | 2684640 | Y | 3/2005 |

(Continued)

*Primary Examiner* — Robert G Santos
*Assistant Examiner* — Nicholas Polito
(74) *Attorney, Agent, or Firm* — John H. Choi

(57) ABSTRACT

A collapsible bed frame includes two long rods each composed of two connecting rods. The two connecting rods are connected together through a connecting member. Each of the two long rods has two ends and a central portion pivotally connected with an X-shaped support rack, respectively. The X-shaped support rack at the central portion is pivotally connected to the connecting member. Support rods are provided between the long rods and the X-shaped support racks at the two ends. The support rods are adapted to assist in pulling or pushing the X-shaped support racks at the two ends for expanding or collapsing the collapsible bed frame with ease.

15 Claims, 3 Drawing Sheets

FOREIGN PATENT DOCUMENTS

| | | | |
|---|---|---|---|
| CN | 2902036 | Y | 5/2007 |
| GB | 2240034 | A | 7/1991 |
| GB | 2360700 | A | 10/2001 |
| JP | 7-36786 | B2 | 4/1995 |

* cited by examiner

COLLAPSIBLE BED FRAME

BACKGROUND OF THE INVENTION

1. Field of the Invention

The present invention relates to a furniture article, and more particularly to a collapsible bed frame.

2. Description of the Prior Art

There are a variety of collapsible bed frames on the markets. Because they are compact after collapsed, it is convenient to be stored and carried for household use or outdoor activities. Chinese Patent Publication No. CN2329247Y disclosed "a collapsible bed frame", published on Jul. 21, 1999. This collapsible bed frame comprises two long rods, a plurality of X-shaped support racks to support the two long rods, and a bed cloth secured to the two long rods. When the collapsible bed frame is collapsed, the two long rods will be lifted upward and inward and the X-shaped support racks at the two sides will be rotated inward at 90 degrees and then overturned outward at 270 degrees to approach the two long rods so as to finish collapsing. If the long rod is too long, the long rod may be connected by two connecting rods. When expanded or collapsed, the connecting rods are pulled upward or pushed inward and then tied up. After collapsing, the size is small for carrying.

However, there are several steps for expanding or collapsing this collapsible bed frame. After the two long rods are pulled inward, the X-shaped support racks at the two sides are rotated to approach the long rods and then the long rods are folded half. When expanded, the aforesaid steps are executed contrary. This is inconvenient to use.

SUMMARY OF THE INVENTION

The primary object of the present invention is to provide a collapsible bed frame, which is expanded or collapsed with ease.

According to the present invention, there is provided a collapsible bed frame, comprising two long rods each composed of two connecting rods, the two connecting rods being connected together through a connecting member, the two long rods each having two ends and a central portion pivotally connected with an X-shaped support rack respectively, the X-shaped support rack at the central portion being pivotally connected to the connecting member, and characterized by: support rods being provided between the long rods and the X-shaped support racks at the two ends.

The support rods are disposed between the two long rods and the X-shaped support racks at the two ends of the collapsible bed frame so as to assist in pulling or pushing the X-shaped support racks at the two ends for expanding or collapsing the collapsible bed frame with ease. Compared to the prior art, only a step is required to expand or collapse the bed frame with ease. This is very convenient for operation.

DETAILED DESCRIPTION OF THE PREFERRED EMBODIMENTS

Figure 1:
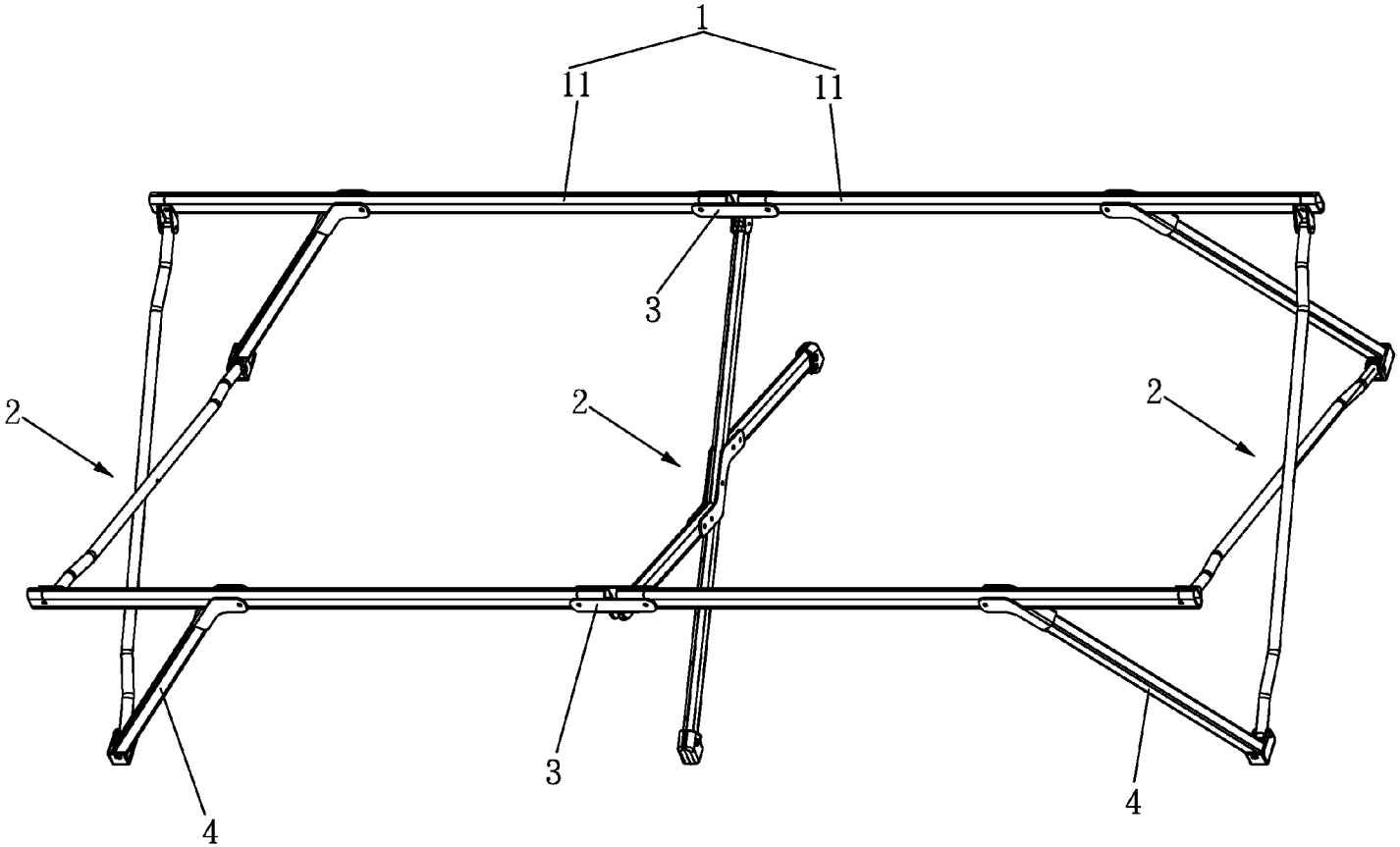
FIG. 1 is a perspective view of the present invention.

As shown in FIG. 1, a collapsible bed frame of the present invention comprises two long rods 1 and a plurality of X-shaped support racks 2 under the two long rods 1.

Each of the two long rods 1 is composed of two connecting rods 11 connected together. Each of the two connecting rods 11 has an inner end pivotally connected to a connecting member 3 so that the two connecting rods 11 are connected together. Each of the two long rods 1 has two ends and a central portion pivotally connected with the X-shaped support racks 2, respectively. The X-shaped support rack 2 at the central portion of the long rod 1 is pivotally connected to the connecting member 3.

The difference between the present invention and the prior art is that support rods 4 are provided between the two ends of the long rods 1 and the X-shaped support racks 2, respectively. When the collapsible bed frame is expanded, the support rods 4 will support the X-shaped racks 2 at the two ends securely. In addition, the support rods 4 assist the X-shaped support racks 2 in expanding or collapsing.

Figure 2:
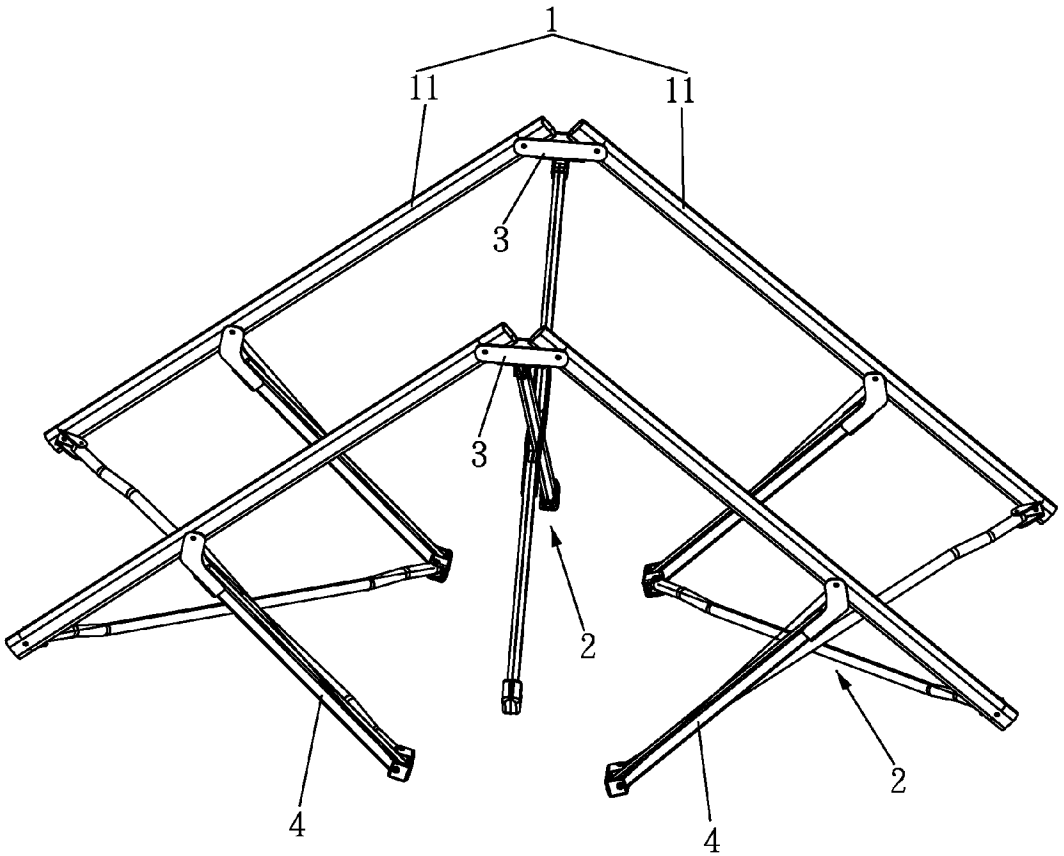
FIG. 2 is a schematic view showing the collapsing operation of the present invention.
Figure 3:
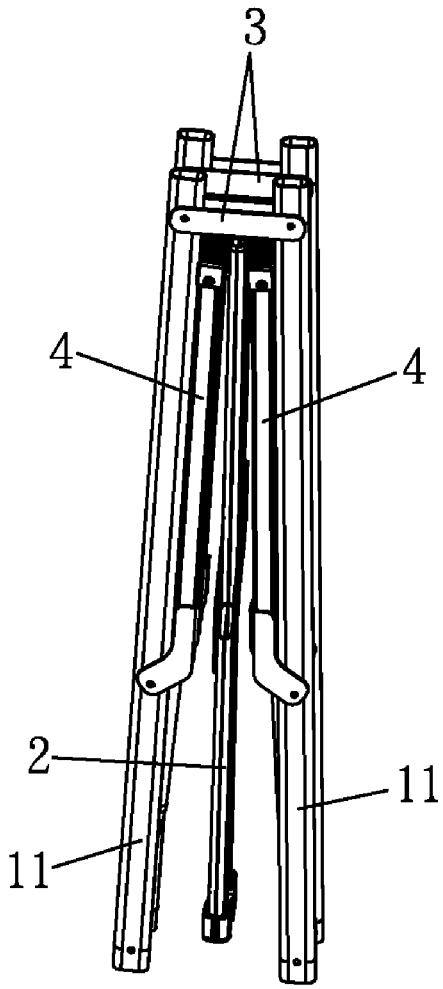
FIG. 3 is a schematic view of the present invention in a collapsed status.

As shown in FIG. 2, when the present invention is collapsed, the central portions of the long rods 1 will be lifted upward and inward and the two connecting rods 11 will be collapsed downward. The support rods 4 are brought to move inward. During the collapse, the bottoms of the X-shaped support racks 2 at the two ends are pulled to move the X-shaped support racks 2 at the two ends inward. When the connecting rods 11 are collapsed vertically, the X-shaped support racks 2 at the two ends are almost close to the connecting rods 11 and at two sides of the X-shaped support rack 2 at the central portion, as shown in FIG. 3. When the collapsible bed frame is expanded, the connecting rods 11 will be pulled upward and the support rods 4 will push the X-shaped support racks 2 at the two ends to prop up automatically. According to the aforesaid, the support rods 4 are adapted to assist in pulling or pushing the X-shaped support racks 2 at the two ends for expanding or collapsing the collapsible bed frame with ease.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A collapsible bed frame foldable between an expanded configuration and a collapsed configuration, the bed frame comprising two elongated rods (1) each comprising two connecting rods (11);

the two connecting rods (11) being pivotally connected together through a connecting member (3), the two elongated rods (1) each having two outer ends and a central portion pivotally connected with an X-shaped support rack (2), respectively, the X-shaped support rack (2) at the central portion being attached to the connecting members (3) at a location between the connecting rods (11) and pivotable with respect to the connecting members (3); and the X-shaped support racks (2) at the outer ends of the elongated rods (1) characterized by: at least one single-piece support rod (4) having a proximal end and a distal end, the proximal end of the at least one single-piece support rod (4) fixedly pivotally attached to at least one of the elongated rods (1) and the distal end of the at least one single-piece support rod (4) pivotally connected to at least one of the X-shaped support racks (2) when the bed frame is in the expanded configuration and in the collapsed configuration.

2. The collapsible bed frame according to claim 1, wherein in the expanded configuration of the bed frame, the two connecting rods (11) of each elongated rod (1) are longitudinally aligned with each other, and the X-shaped support racks (2) and the at least one single-piece support rod (4) are fully extended.

3. The collapsible bed frame according to claim 1, wherein in the collapsed configuration of the bed frame, the connecting rods (11), the X-shaped support racks (2) and the at least one single-piece support rod (4) are folded inward and substantially parallel and adjacent to each other.

4. The collapsible bed frame according to claim 1, wherein the distal end of the at least one single-piece support rod (4) is connected to a lower portion of the at least one of the X-shaped support racks (2).

5. The collapsible bed frame according to claim 4, wherein the distal end of the at least one single-piece support rod (4) is connected to a lower end of the at least one of the X-shaped support racks (2).

6. The collapsible bed frame according to claim 1, wherein the X-shaped support racks (2) at the outer ends of the elongated rods (1) are each defined by a pair of support legs that intersect adjacently at a predetermined area with respect to each other.

7. A collapsible bed frame, foldable between an expanded configuration and a collapsed configuration, the bed frame comprising two elongated rods (1) each having two outer ends and a central portion;

each elongated rod (1) comprising two connecting rods (11) pivotally connected together through a connecting member (3);

X-shaped support racks (2), each pivotally connected with the elongated rods (1) at opposing outer ends of the elongated rods (1) and at opposing central portions of the elongated rods (1), the X-shaped support rack (2) at the central portion being attached to the connecting members (3) at a location between the connecting rods (11) and pivotable with respect to the connecting members (3); and at least one support rod (4) having first and second ends, the at least one support rod first end pivotally connected to a lower portion of at least one X-shaped support rack (2) and the at least one support rod second end fixedly pivotally attached to at least one elongated rod (1) when the bed frame is in the expanded configuration and in the collapsed configuration.

8. The collapsible bed frame according to claim 7, wherein in the expanded configuration of the bed frame, the two connecting rods (11) of each elongated rod (1) are longitudinally aligned with each other, and the X-shaped support racks (2) and the at least one support rod (4) are fully extended.

9. The collapsible bed frame according to claim 7, wherein in the collapsed configuration of the bed frame, the connecting rods (11), the X-shaped support racks (2) and the at least one support rod (4) are folded inward and substantially parallel and adjacent to each other.

10. The collapsible bed frame according to claim 7, wherein the at least one support rod (4) first end is connected to a lower end of the at least one X-shaped support rack (2).

11. A collapsible bed frame, foldable between an expanded configuration and a collapsed configuration, the bed frame comprising:

two elongated rods (1) each having two ends, each elongated rod (1) comprised of two connecting rods (11), the two connecting rods (11) being pivotally connected together with a connecting member (3) to form a pivotal connection, corresponding ends of each elongated rod (1) pivotally connected with an outer X-shaped support rack (2) respectively, an inner X-shaped support rack (2) attached to opposing connecting members (3) at a location between the connecting rods (11) and pivotable with respect to the connecting members (3), each X-shaped support rack defined by a pair of support legs that intersect adjacently at a predetermined area with respect to each other; and at least one single-piece support rod (4) having first and second ends, the at least one single-piece support rod first end pivotally connected to at least one X-shaped support rack (2) and the at least one single-piece support rod second end fixedly pivotally attached to at least one elongated rod (1) when the bed frame is in the expanded configuration and in the collapsed configuration.

12. The collapsible bed frame according to claim 11, wherein in the bed frame's expanded configuration, the two connecting rods (11) of each elongated rod (1) are longitudinally aligned with each other, and the X-shaped support racks (2) and the at least one single-piece support rod (4) are fully extended.

13. The collapsible bed frame according to claim 11, wherein in the bed frame's collapsed configuration, the connecting rods (11), X-shaped support racks (2) and the at least one single-piece support rod (4) are folded inward and substantially parallel and adjacent one another.

14. The collapsible bed frame according to claim 11, wherein the at least one single-piece support rod (4) first end is connected to a lower portion of the at least one X-shaped support rack (2).

15. The collapsible bed frame according to claim 14, wherein the at least one single-piece support rod (4) first end is connected to a lower end of the at least one X-shaped support rack (2).

* * * * *